US006263633B1

(12) United States Patent
Hagenah

(10) Patent No.: US 6,263,633 B1
(45) Date of Patent: Jul. 24, 2001

(54) PAVING STONE, SET OF PAVING STONES AND DEVICE FOR PRODUCING THE SAME

(75) Inventor: Gerhard Hagenah, Worpswede (DE)

(73) Assignee: SF-Kooperation GmbH Beton-Konzepte, Bremen (DE)

( * ) Notice: Subject to any disclaimer, the term of this patent is extended or adjusted under 35 U.S.C. 154(b) by 0 days.

(21) Appl. No.: 09/530,199

(22) PCT Filed: Sep. 25, 1998

(86) PCT No.: PCT/EP98/06118

§ 371 Date: Apr. 26, 2000

§ 102(e) Date: Apr. 26, 2000

(87) PCT Pub. No.: WO99/22072

PCT Pub. Date: May 6, 1999

(30) Foreign Application Priority Data

Oct. 27, 1997 (DE) ..... 197 47 421

(51) Int. Cl.[7] ..... E04B 5/04; E04C 2/04

(52) U.S. Cl. ..... 52/596; 52/392; 52/607; 404/34

(58) Field of Search ..... 52/596, 392, 607; 404/34, 37, 38, 39, 41

(56) References Cited

U.S. PATENT DOCUMENTS

| | | | | |
|---|---|---|---|---|
| 1,384,042 | | 7/1921 | Brotsch, Jr. . | |
| 5,028,167 | * | 7/1991 | Scheiwiller | 52/603 |
| 5,133,620 | * | 7/1992 | Scheiwiller | 52/603 |
| 5,560,173 | * | 10/1996 | Scheiwiller | 52/605 |

FOREIGN PATENT DOCUMENTS

| | | |
|---|---|---|
| 812 675 | 9/1951 | (DE) . |
| 1 895 645 | 7/1964 | (DE) . |
| 1 907 841 | 1/1965 | (DE) . |
| 1 917 843 | 6/1965 | (DE) . |
| 66 10 213 | 7/1968 | (DE) . |
| 72 38 737 | 4/1973 | (DE) . |
| 26 10 735 | 9/1977 | (DE) . |
| 37 22 683 | 1/1989 | (DE) . |
| 43 03 321 | 8/1994 | (DE) . |
| 94 11 147 | 9/1994 | (DE) . |
| 94 04 364 | 10/1994 | (DE) . |
| 94 18 766 | 2/1995 | (DE) . |
| 295 10 837 U | 10/1995 | (DE) . |
| 296 02 675 U | 5/1996 | (DE) . |
| 296 07 105 U | 8/1996 | (DE) . |
| 296 15 345 U | 4/1997 | (DE) . |
| 719 622 | 7/1996 | (EP) . |
| 752 500 | 1/1997 | (EP) . |
| 1402464 | 7/1964 | (FR) . |
| 94 554 | 9/1969 | (FR) . |

* cited by examiner

*Primary Examiner*—Carl D. Friedman
*Assistant Examiner*—Chi Nguyen
(74) *Attorney, Agent, or Firm*—Sughrue, Mion, Zinn, Macpeak & Seas, PLLC

(57) ABSTRACT

The invention relates to horizontally and vertically linked paving stones (10). According to the invention, projections (18) and recesses (19) are provided in the area of the bottom part (16) of the paving stones (10) used for a paved surface in order to link said paving stones horizontally and vertically. These projections and recesses engage with each other with a positive fit so as to interlock adjacent stones in a horizontal and vertical direction. The paving stones (10) are characterised in that the width of the joints (32) formed between adjacent paving stones (10) increases in a downward direction so as to form a gap which diverges downwards. This means that the material used for filling the joints can be introduced efficiently and reliably as far as the underside.

13 Claims, 8 Drawing Sheets

Fig. 3
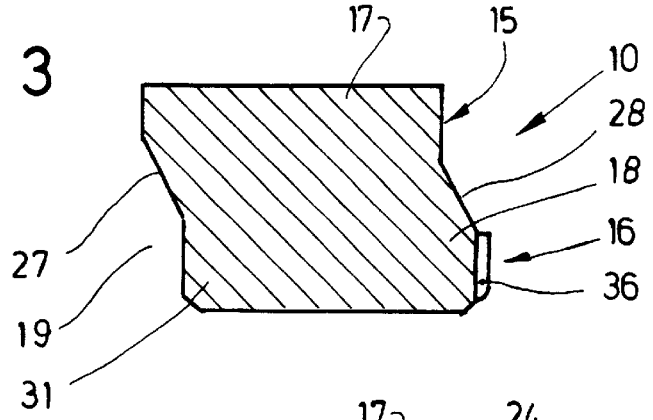
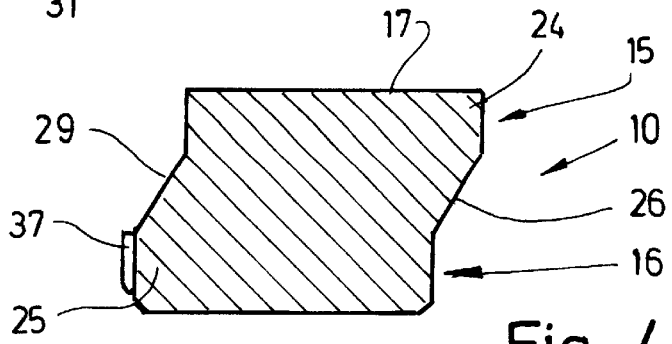
Fig. 4
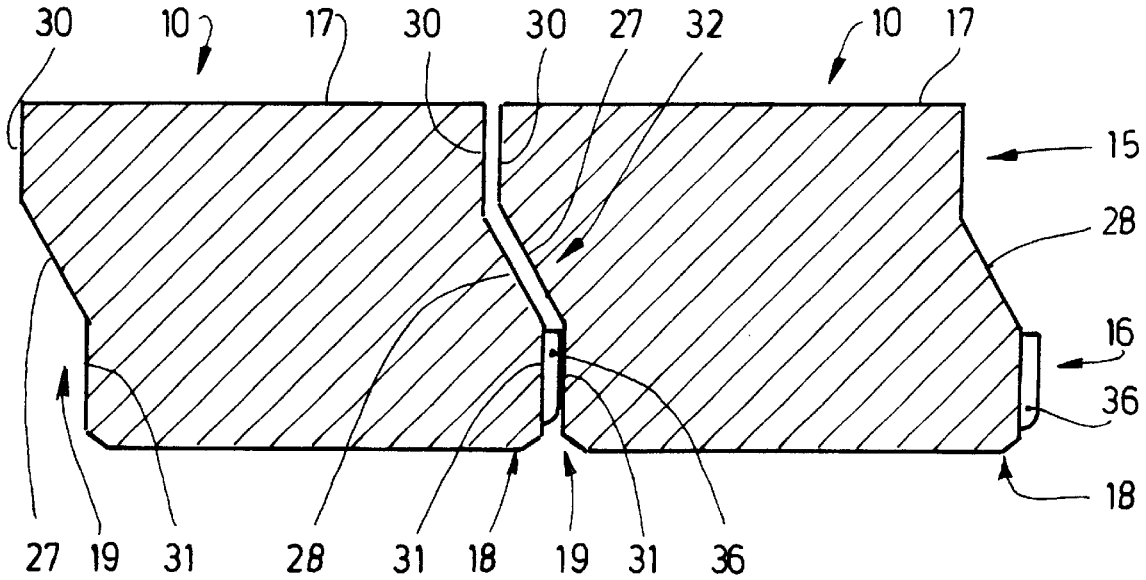
Fig. 5

PAVING STONE, SET OF PAVING STONES AND DEVICE FOR PRODUCING THE SAME

BACKGROUND OF THE INVENTION

The invention relates to a (concrete) paving stone for producing surfacings over the ground, in particular paved surfaces, the paving stones being laid with (longitudinal and transverse) joints being formed between adjacent paving stones and the joints being filled with joint filling material. The invention also relates to a set of paving stones and a device for producing paving stones for curved sets.

The forming of paving stones from concrete has to meet increasingly high requirements. The outer appearance is to be attractive. Nevertheless, the paving stones are to form a surfacing over the ground that is resistant to rolling traffic loads by vertically and horizontally interlocking with adjacent paving stones—horizontal and vertical linkage. The invention is concerned with paving stones which ensure by the way in which they are formed a horizontal linkage and a vertical linkage within the paved surface. It deals with the special forming of such paving stones and the production of paving stones for curved sets.

SUMMARY OF THE INVENTION

The invention is based on the object of designing paving stones with horizontal linkage and vertical linkage in such a way that a supporting, load-bearing surfacing over the ground can be produced and special configurations of paved surfaces are possible.

To achieve this object, the paving stone according to the invention is characterized in that the joints formed between the adjacent paving stones have on account of appropriate shaping of side surfaces of the paving stones a cross section diverging downwards from an upper side of the stone to an underside of the stone.

The way in which the paving stone is formed according to the invention ensures that the longitudinal joints and/or transverse joints between the adjacent paving stones permit reliable filling with joint filling material, in particular sand and/or gravel. According to the invention, the gap width of the joints increases downwards, so that wedging of particles of the joint filling material is avoided. Wherever the joints are bounded by corresponding sloping surfaces of the paving stones, they have an angle which is less than the angle of repose of the joint filling material, in other words in particular less than 30°.

Furthermore, it is envisaged that the paving stones are provided with spacers at certain, selected regions of the side surfaces, to be specific exclusively in the region of a lower part of the stone.

For forming a paved surface with obliquely directed rows of paving stones, a set of edge stones according to the invention is proposed.

Finally, the invention comprises the special shaping of a concrete stone mould for the production of wedge-shaped paving stones. For this purpose, according to the invention moulding ridges are arranged on a pulling plate, converging in the pulling direction of the said plate. In a corresponding way, the (wedge-shaped) paving stones of different sizes are arranged in rows in such a way that the (transverse) dimensions decrease in the pulling direction of the pulling plate.

BRIEF DESCRIPTION OF DRAWINGS

Further details of the invention relate to the shaping of the paving stones or sets and to the device for producing the same. Exemplary embodiments of the paving stones, the sets and the device are explained in more detail below with reference to the drawings, in which:

FIG. 3 shows a cross section through the paving stone according to FIG. 1 and FIG. 2 in a central transverse plane, FIG. 4 shows a cross section through the paving stone according to FIG. 1 and FIG. 2 in a lateral transverse plane, FIG. 5 shows a detail of a paved surface, to be specific two adjacent paving stones, in vertical section.

DETAILED DESCRIPTION OF THE INVENTION

Figure 1:
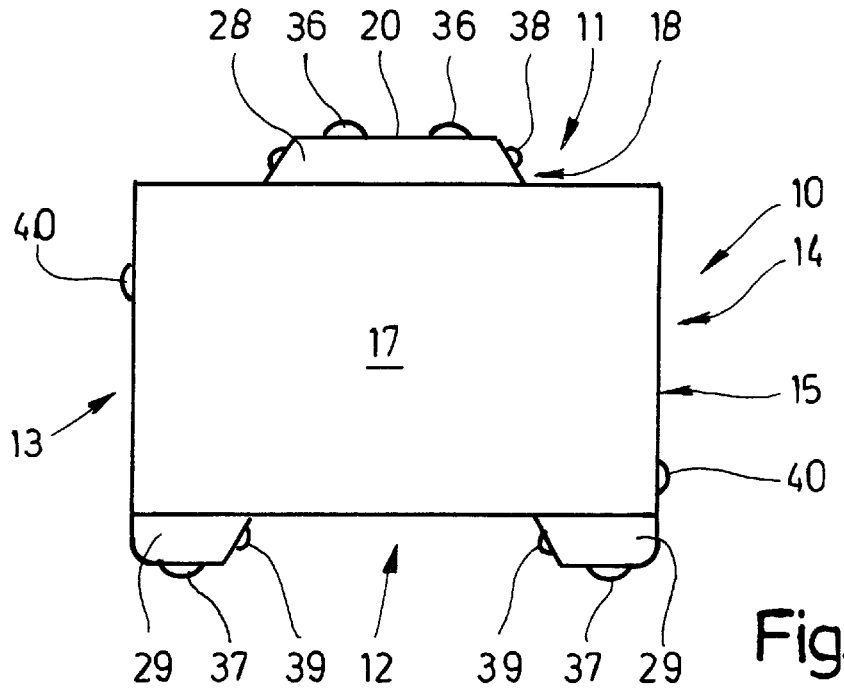
FIG. 1 shows a paving stone with horizontal and vertical linkage in plan view.

FIG. 1 to FIG. 5 show details of a concrete paving stone 10 designed in a special way. It is of a rectangular design in horizontal projection, with longitudinal sides 11 and 12 and transverse sides 13 and 14. In the region of the longitudinal sides 11, 12, the paving stone 10 is "interlocked" by projections and depressions in such a way that adjacent paving stones 10 within a paved surface are laid such that they are linked in the horizontal and vertical directions (horizontal and vertical linkage). The upright transverse sides 13 and 14 on these paving stones 10 are formed with a smooth surface, in other words without a linking effect.

The paving stone 10 comprises an upper part 15 of the stone and a lower part 16 of the stone. The upper part 15 of the stone is of a rectangular design in plan view, or is provided with a rectangular upper side 17 of the stone.

The underside 16 of the stone has projections and depressions, which permit the mutual interlocking of adjacent paving stones 10 and consequently the horizontal and vertical linkage. This linkage is not evident from outside or above when laying of the paved surface has been completed (for example FIG. 7), because the upper sides 17 of the stones are exclusively of a rectangular design, for example.

In the case of the present exemplary embodiment, the lower part 16 of the stone is provided in the region of one longitudinal side 11 with a central protection 18. Formed opposite this is a correspondingly designed depression 19. Projection 18 and corresponding depression 19 are trapezoidally formed, in other words with an outer surface 20 running parallel to the longitudinal side 11 and a corresponding inner surface 21 as well as with likewise corresponding obliquely running flanks 22, 23. The projection 18 includes lateral corner depressions 24 and respectively corresponding corner projections 25 as a (part) limitation of the depression 19.

Figure 2:
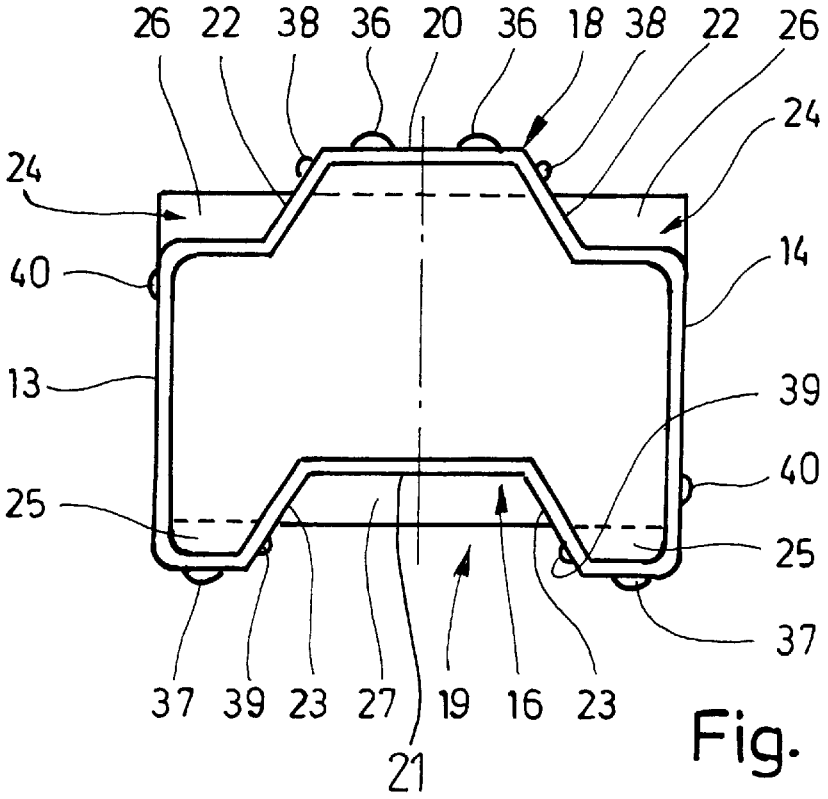
FIG. 2 shows the paving stone according to FIG. 1 in a view from an underside.

The transition from the (rectangular) upper part 15 of the stone to the complexly formed lower part 16 of the stone takes place over obliquely running intermediate surfaces, to be specific sloping surfaces 26 in the region of the corner depressions 24 on the one hand and a sloping surface 27 in the region of the depression 19 on the other hand. Sloping surfaces 28, 29 are also respectively formed between the projection 18 on the one hand and the upper part 15 of the stone on the other hand and between the corner projections 25 on the one hand and the upper part 15 of the stone on the other hand. The latter can be seen in a plan view of the paving stone 10 (FIG. 1), whereas the sloping surfaces 26, 27 appear as visible surfaces in a view of the paving stone 10 from below (FIG. 2).

The paving stones 10 laid to form a paved surface (FIG. 5, FIG. 6, FIG. 7) are mutually interlocked with one another. The projection 18 of one paving stone 10 enters the depression 19 of an adjacent paving stone with a positive fit. In the same way, the corner projections 25 protrude into corner projections 24 of an adjacent paving stone 10. The vertical offset between the upper part 15 of the stone and regions of the lower part 16 of the stone additionally produces vertical linkage because the sloping surfaces 26 bear against the sloping surfaces 29 and the sloping surface 27 bears against the sloping surface 28.

Upright stone surfaces 30 of the upper part 15 of the stone and stone surfaces 31 of the lower part 16 of the stone are designed—in a way similar to sloping surfaces 26 . . . 29—in such a way that the laid paving stones 10 form joints diverging downwards, in other words widening downwards from the upper side 17 of the stone. This applies in particular to longitudinal joints 32 in the region of the interlocking and expediently also in an analogous way to transverse joints 33 in the region of smooth-surfaced, approximately vertical transverse sides 13, 14. For this purpose, the relevant stone surfaces of the paving stones 10 lying opposite one another for forming a longitudinal joint 32 or a transverse joint 33 are made to be slightly oblique with respect to an (imaginary) vertical plane, for example by an angle of 1° to 2°. The region of the sloping surfaces 26 . . . 29 is designed in an analogous way, in other words likewise with a gap widening gradually downwards. Furthermore, the inclination of the sloping surfaces 26 . . . 29 is chosen such that the angle of inclination with respect to an (imaginary) vertical plane is not greater than the angle of repose of joint filling material, in other words for example sand or gravel. This means that in practice the angle of the sloping surfaces 26 . . . 29 is not greater than 30°. This downwardly opening cross-sectional form of the joints ensures trouble-free introduction of the joint filling material over the complete height of the joints.

To ensure an exact relative position of the paving stones 10 within a paved surface, spacers are moulded on at selected positions. These are located exclusively in the region of the lower part 16 of the stone, and are accordingly not visible from the upper side of a paved surface.

In the case of the present exemplary embodiment, two spacers 36 are arranged at a distance from one another on the outer surface 20 of the projection 18. These bear against an adjacent paving stone in the region of the depression 19. Furthermore, the two corner projections 25 are respectively provided with a spacer 37. Smaller spacers 38 and 39 are provided on the flanks 22 and 23 of the projection 18 on the one hand and the depression 19 on the other hand. The spacers 38 on the one hand and 39 on the other hand are positioned in such a way that they lie at a distance from one another when the paving stones have been laid. Finally, a spacer 40 is provided on each transverse side 13, 14. These spacers 40 are also positioned in an offset manner, so that they respectively bear against adjacent paving stones 10 at a distance from one another.

Figure 6:
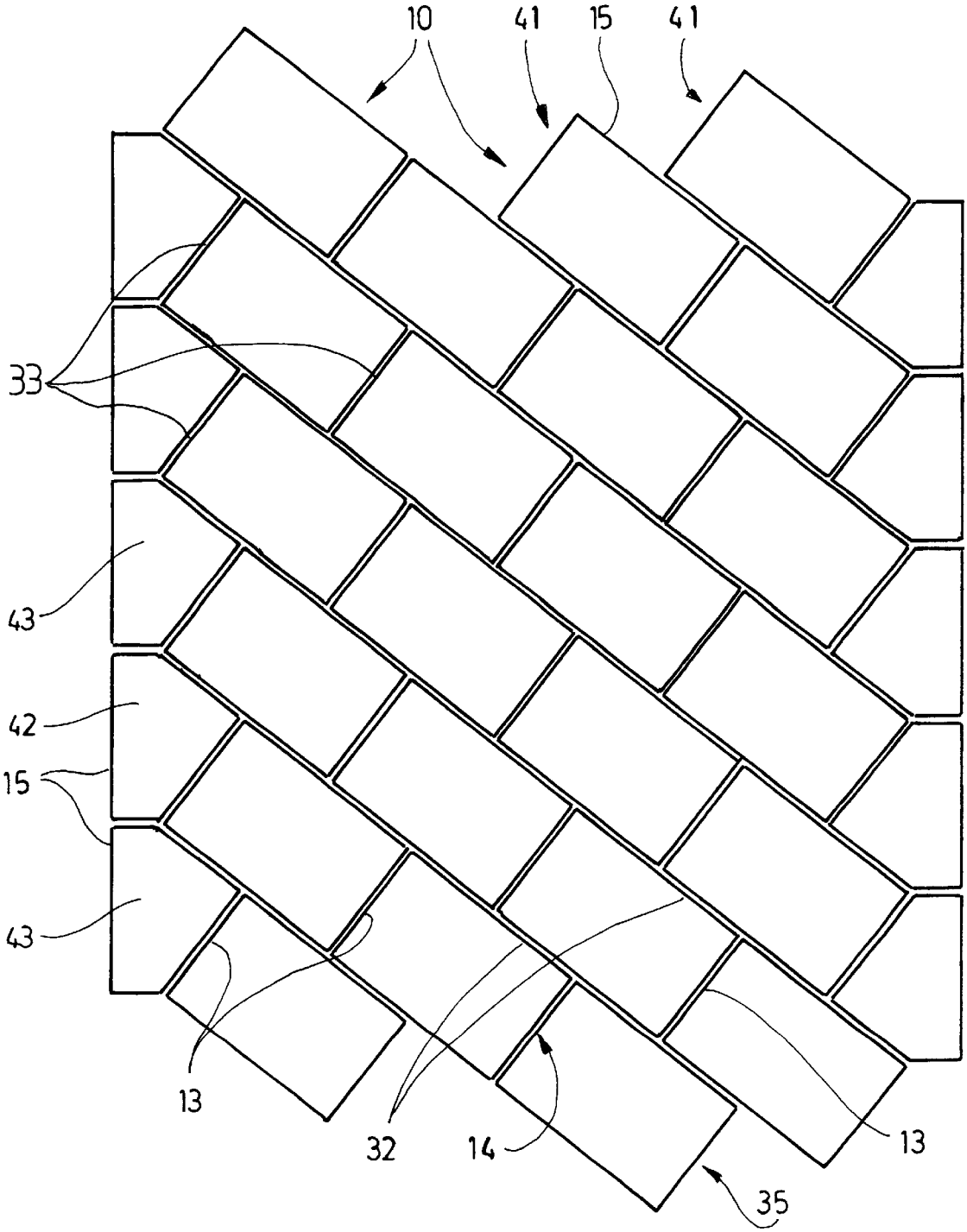
FIG. 6 shows a portion of a paved surface in plan view.
Figure 7:
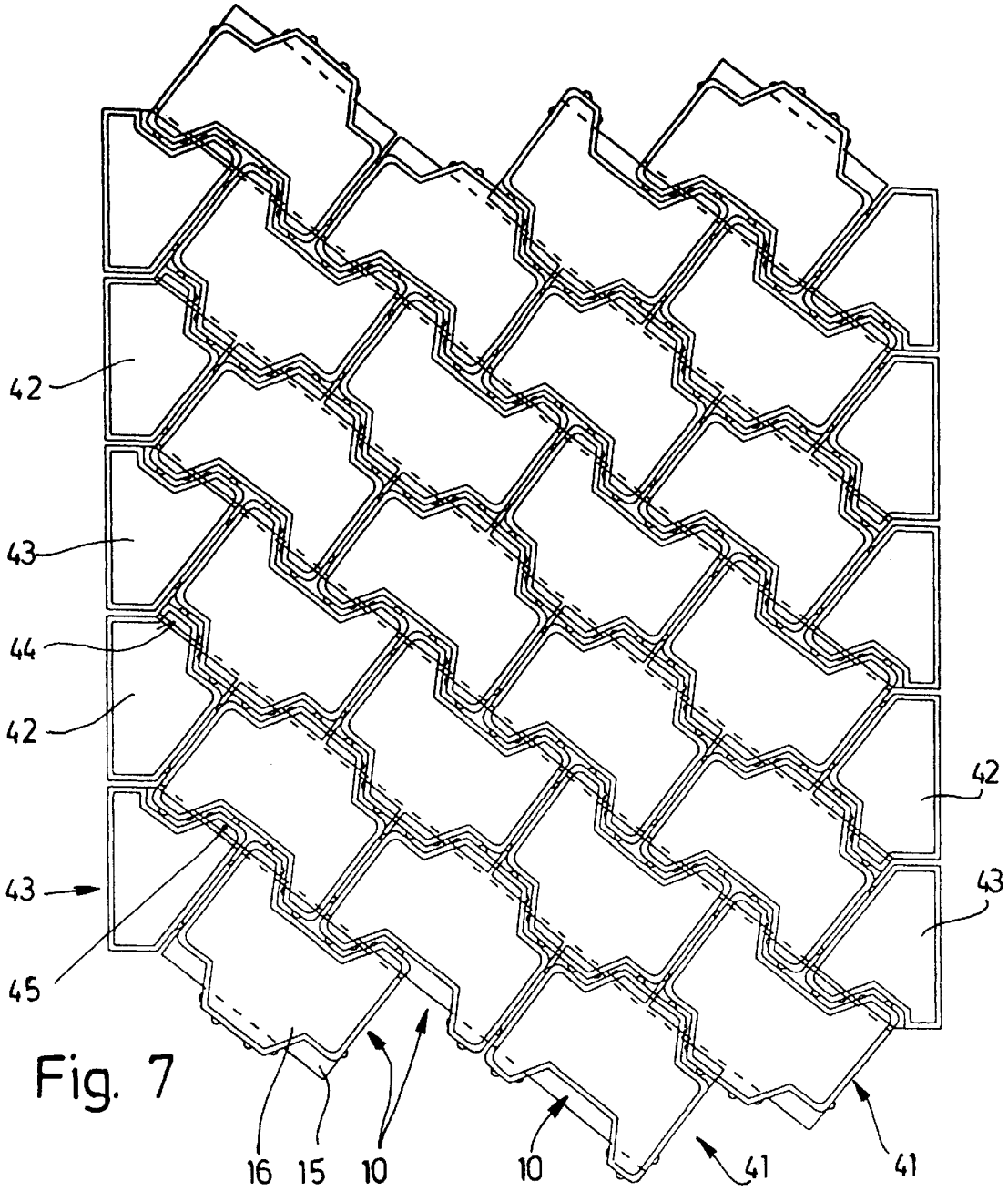
FIG. 7 shows the paved surface according to FIG. 6 in a view from below.
Figure 8:
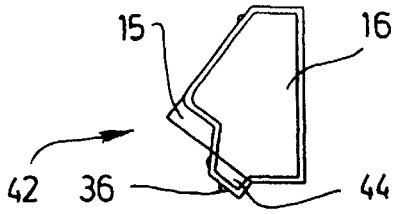
FIG. 8 shows a paving stone, to be specific an edge stone, for a paved surface according to FIG. 7 in a view from below.
Figure 9:
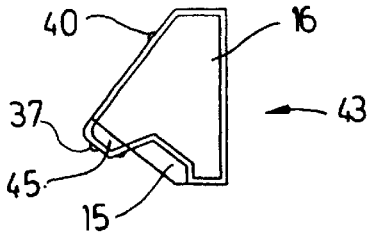
FIG. 9 shows a further edge stone for the paved surface according to FIG. 7 in a view from below.
Figure 10:
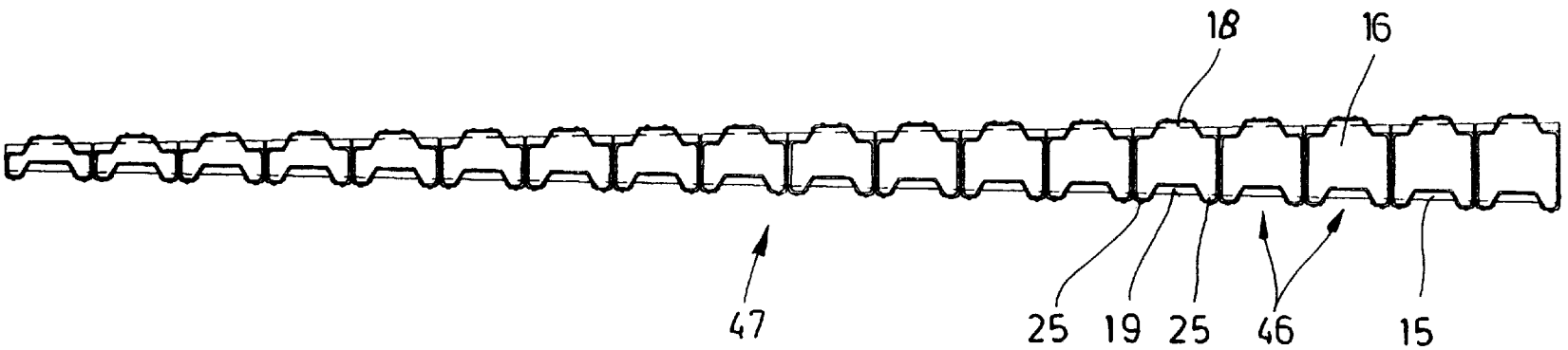
FIG. 10 shows a set of paving stones, to be specific a curved set, in a view from below.

A further special feature is revealed by FIG. 6 to FIG. 9. Here, paving stones 10 are laid in obliquely directed rows 41 of stones. FIG. 6 shows a view from the upper side 17 of the stones, FIG. 7 shows a view from below with the horizontal and vertical interlocking.

Edge stones 42, 43 are designed in a special way. To ensure interlocking or linking up to straight, parallel edges of the paved surface, the edge stones 42, 43 are designed in the region of the lower part 16 of the stone in such a way that they in each case adjoin with a positive fit to obliquely directed rows 41 of stones and form a straight termination on the outer side. In the region of the upper part 15 of the stone, the edge stones 42, 43 are of a coinciding design, to be specific with a rectangular subregion and a triangular subregion (FIG. 6). The triangular region in this case adjoins two adjacent rows 41 of stones.

The lower part 16 of the stones are of a differing design. In the case of the edge stone 42 (FIG. 8), there is formed a part-projection 44, which enters with a fit into the region of a corner depression 24 of an adjacent paving stone 10. The other edge stone 43 is instead provided with a corner projection 45—analogous to the corner projection 25 of a paving stone. The corner projection 45 enters—with a corner projection 25 of an adjacent paving stone 10—into a depression 19 of a paving stone 10 of the adjacent row 41 of stones.

This shaping of the edge stones 42, 43 applies to laying of the paving stones 10 with the rows of stones 41 offset in relation to one another. The paving stones 10 are laid with a half-bond, two corner projections 25 of adjacent paving stones 10 respectively entering into a depression 19 of a paving stone 10 of the adjacent row 41 of stones.

A further special feature concerns the shaping and production of paving stones with converging longitudinal sides 11, 12, to be specific curved stones. A set of geometrically matching curved stones 46, to be specific increasing in the transverse dimension in a wedge-shaped manner, produces a curved set 47 according to FIG. 11. By laying a number of curved sets 47 next to one another, a paved surface can be produced along an arcuate route.

In the present case, both longitudinal sides 11, 12 of the curved stones 46 are obliquely arranged, in other words running in a wedge-shaped manner. This applies both to the upper part 15 of the stone and to the lower part 16 of the stone. As a result, a full linking effect, that is with horizontal and vertical linkage, is obtained in the region of the curved sets 47 as well.

One special feature is the production of such curved stones 46. Concrete stones are usually produced in concrete moulds which have a number of mould cavities that are open at the top and bottom. These are filled with the fresh concrete. On the underside, the mould cavities are closed by an underlay board. Mould dies enter the individual mould cavities from above, to ensure an upper limitation for the concrete stones.

Figure 11:
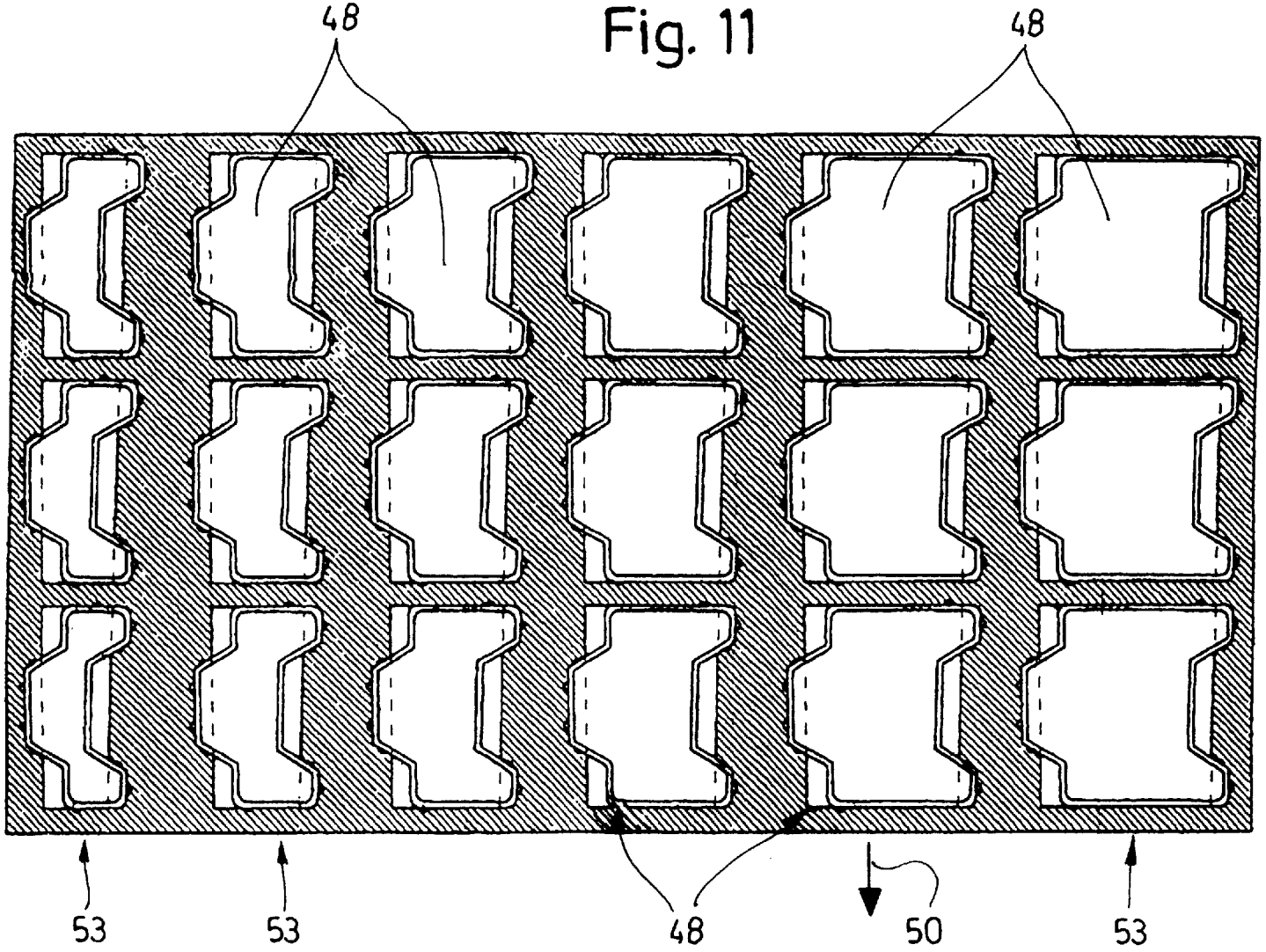
FIG. 11 shows a device, to be specific a stone mould, for producing paving stones in plan view.
Figure 12:
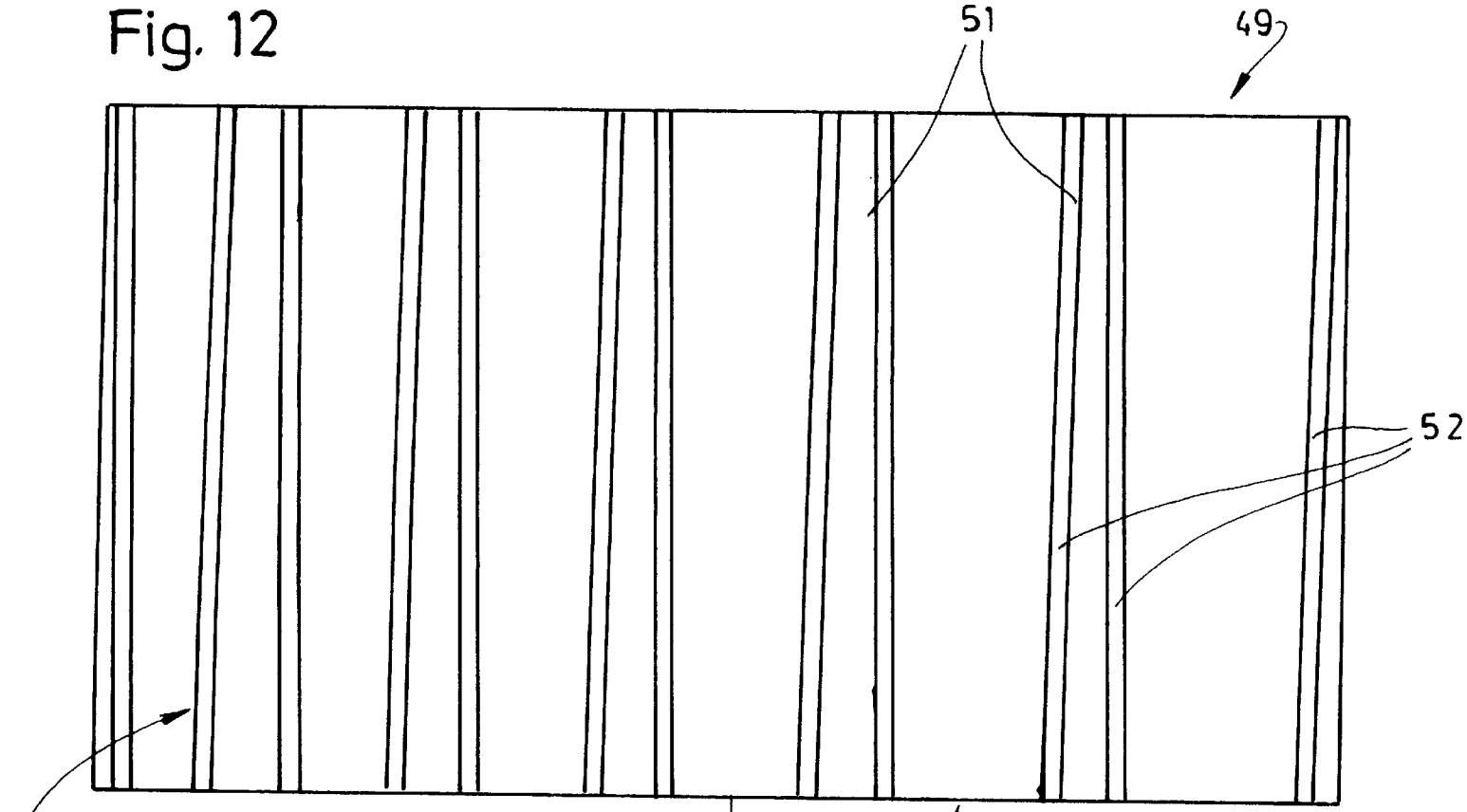
FIG. 12 shows a detail of the device according to FIG. 11, to be specific a pulling plate, likewise in plan view.
Figure 13:
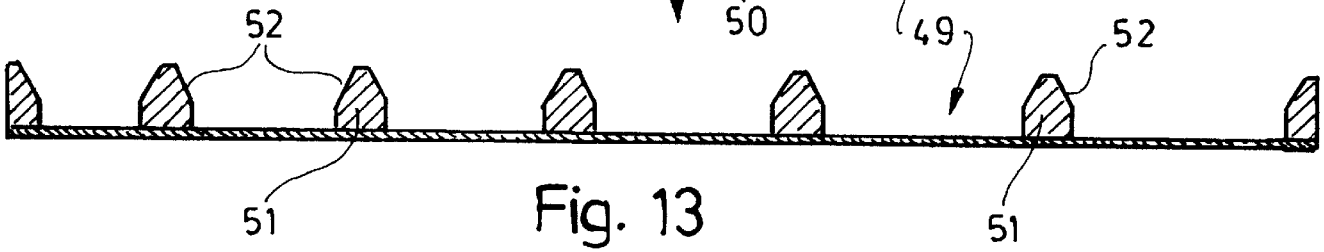
FIG. 13 shows the pulling plate according to FIG. 12 in cross section.

FIG. 11 shows such a concrete mould in plan view. The mould cavities 48 are designed in such a way that the upper part 15 of the stone, in other words the upper side 17 of the stone, is facing downwards and the lower part 16 of the stone with the interlockings is facing upwards. Mould dies which have the contour of the lower part 16 of the stone in horizontal projection enter the mould cavities from above. The lower part 16 of the stone rests on a special pulling plate 49, a plate-shaped, thin-walled element which is pulled out to the side after moulding of the paving stones 10 or the curved stones 46 within the mould cavities 48, so that after that the (fresh) stones rest on the underlay (underlay board) lying underneath. The pulling plate 49 has the task of moulding the regions of the upper part 15 of the stone on the longitudinal sides 11, 12 and also the undercuts, that is the sloping surfaces 28 and 29.

Figure 14:
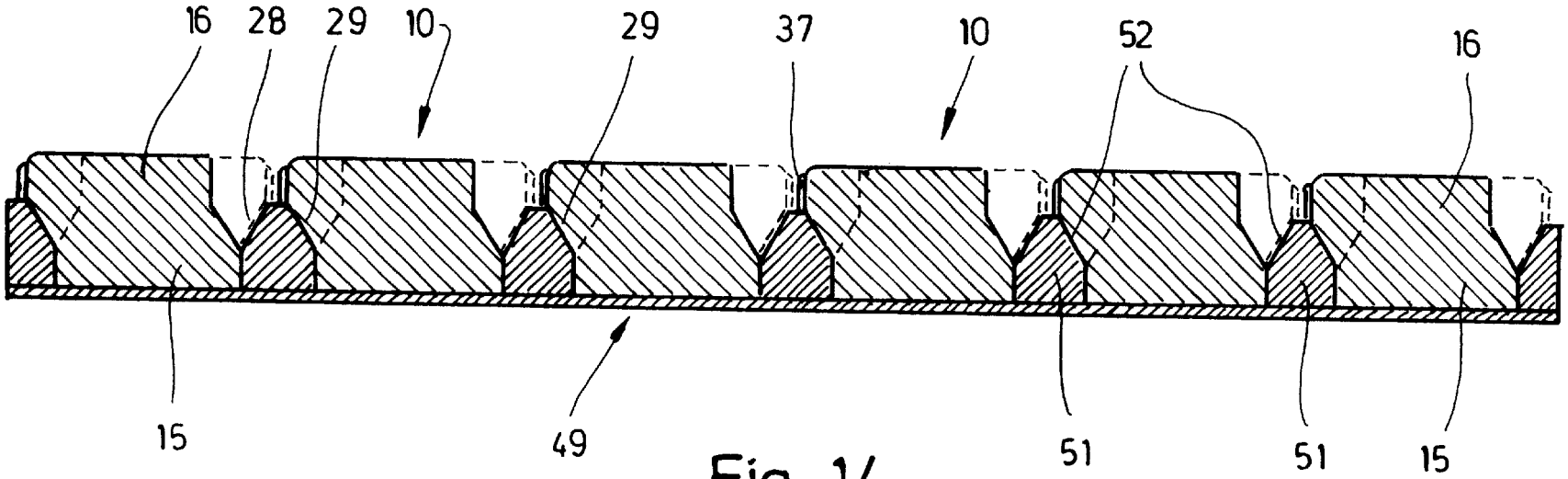
FIG. 14 shows paving stones resting on a pulling plate in cross section.

For this purpose, moulding ridges 51, running in the direction of the pulling movement according to arrow 50, are arranged on the upper side of the pulling plate 49. These are upright ribs which run transversely with respect to the pulling plate 49 and, with side surfaces, mould the form of a lower subregion of the paving stones 10 or curved stones 46, to be specific the upper part 15 of the stone. For this purpose, the moulding ridges 51 are of a roof-shaped design in the upper cross-sectional region. The sloping moulding surfaces 52 thus formed bear against undercut or downwardly directed sloping surfaces 28, 29 (FIG. 14). The upwardly directed sloping surfaces 26, 27, on the other hand, are moulded by the individual moulding dies (not shown) assigned to each mould cavity 48.

The pulling plate 49 is in the present case set up for the forming of curved stones 46. For this purpose, the moulding ridges 51 have a cross-sectional form diverging in the pulling direction (FIG. 14). The width of the moulding ridges 51 increases in the pulling direction. Corresponding to this forming of the moulding ridges is the positioning of the mould cavities 48 within the concrete mould (FIG. 11). The mould cavities, arranged in longitudinal and transverse rows, are distributed with regard to size in such a way that the transverse dimension of the wedge-shaped curved stones 46 decreases in the pulling direction according to arrow 50. Accordingly, in each transverse row 53 of the mould cavities 48 the width decreases in the pulling direction according to arrow 50, to be precise in a wedge-shaped manner, so that moulding ridges 51 of a correspondingly wedge-shaped design respectively bear with a width increasing in the pulling direction against the mutually facing longitudinal sides 11, 12 of the curved stones 46 of adjacent transverse rows 53. This relative position also makes trouble-free demoulding possible, to be specific pulling out of the pulling plate 49 in the direction of the arrow 50. The width of the moulding ridges 51 decreasing counter to the pulling direction allows the said moulding ridges to be pulled out between the transverse rows 53. When this happens, the form of the longitudinal sides 11, 12 in the region of the lower part 16 of the stone and the undercut sloping surfaces 28, 29 is preserved. After pulling away the pulling plate 49, the mould frame is raised, then the mould dies. The underlay board (not shown) can then be conveyed away with the wedge-shaped concrete stones in the usual way.

The design principle of the concrete mould and the pulling plate 49 can also be used in the case of differently formed wedge-shaped concrete stones with undercuts.

List of Reference Numerals

10 paving stone
11 longitudinal side
12 longitudinal side
13 transverse side
14 transverse side
15 upper part of stone
16 lower part of stone
17 upper side of stone
18 projection
19 depression
20 outer surface
21 inner surface
22 flank
23 flank
24 corner depression
25 corner projection
26 sloping surface
27 sloping surface
28 sloping surface
29 sloping surface
30 surface of stone
31 surface of stone
32 longitudinal joint
33 transverse joint
36 spacer
37 spacer
38 spacer
39 spacer
40 spacer
41 row of stones
42 edge stone
43 edge stone
44 part-projection
45 corner projection
46 curved stone
47 curved set
48 mould cavity
49 pulling plate
50 arrow
51 moulding ridge
52 moulding surface
53 transverse row.

What is claimed is:

1. A paving stone (10), made of concrete, for producing a paved surface formed by a plurality of paving stones (10) which are laid next to one another to form, between adjacent paving stones (10), longitudinal and transverse joints (32, 33) which are filled with joint filling material, wherein:

the paving stone (10) comprises an upper stone part (15), which is rectangular or square in a horizontal projection thereof, and a lower stone part (16) having a central projection (18), a depression (19) and two corner projections (25);

the lower stone part (16) projects at a first longitudinal side (11) of the paving stone to from the central projection (18) having a horizontal projection which extends partially beyond an outer contour of the upper stone part (15);

between the corner projections (25), the lower stone part (16) is partially recessed to form the depression (19) in a horizontal projection with respect to the outer contour of the upper stone part (15);

the central projection (18) and the depression (19) have a trapezoid-shaped horizontal projection and have corresponding dimensions;

the two corner projections (25) are formed in their common horizontal projection to correspond in shape and dimension to the depression (19); and the paving stone has two transverse sides (13, 14) each of which extends essentially as a smooth, vertical and continuous plane over said lower stone part (15) and said upper stone part (16).

2. The paving stone (10) according to claim 1, wherein the central projection (18) and the depression (19) are each centered on the first and second longitudinal sides (11, 12), respectively.

3. The paving stone (10) according to claim 2, wherein at least one upright side surface of the central projection (18) and the depression (19) extends parallel to at least one of the first and second longitudinal sides (11, 12) of the paving stone (10).

4. The paving stone (10) according to claim 3, wherein: two spacers (36), lying at a distance from one another, are located in a region of the central projection (18); a single spacer (37) is located in a region of each of the corner projections (25); a single off-center spacer (40) is arranged in a region of each of two upright end surfaces (34, 35); and spacers (38, 39) are located in regions of obliquely-directed flanks (22, 23) of the paving stone.

5. The paving stone according to claim 1, wherein a transition from upright side surfaces of the upper stone part (15) to the central projection (18) and the depression (19) of the lower stone part (16) occurs over obliquely running intermediate sloping surfaces (26, 29) which are inclined, with respect to a vertical plane, at an angle of inclination of up to 30° but not greater than an angle of repose of the joint filing material.

6. The paving stone (10) according to claim 1, wherein said joints (32, 33) between adjacent paving stones (10) have a cross section diverging downwards.

7. A set of paving stones (10), each of which is defined in claim 1, for the production of a paved surface, wherein said paving stones (10) are located adjacent to one another in continuous rows (41) of stones, and wherein within a paved surface, the central projection (18) and the depression (19) of one paving stone (10) correspond in each case with depressions or projections, respectively, of two paving stones (10) in respective ones of said rows (41) of stones.

8. The set of paving stones (10) according to claim 1, wherein, within the paved surface, the central projection (18) of each paving stone (10) is inserted between the central projections (18) of two adjacent paving stones (10) of one of said adjacent rows (41) of stones, and wherein the corner projections (25) of each paving stone (10) are inserted in the depressions (19) of two adjacent paving stones (10) of said one adjacent row (41) of stones.

9. A set of paving stones (10) made of concrete for producing paved surfaces, comprising a plurality of paving stones (10), each according to claim 1, and edge stones (42, 43), wherein:

the paving stones (10) run in continuous rows (41) of stones which are directed obliquely with respect to an imaginary longitudinal direction of the paved surface;

the edge stones (42, 43) form a continuous, straight delimitation of a ground covering;

the edge stones (42, 43) comprise an upper stone part (15) and a lower stone part (16) having a projection and a depression; and the edge stones (42, 43) correspond in a region of the lower stone part (16) with a positive fit to central projections (18) and depressions (19) of adjacent paving stones (10) of two rows (41) of stones lying next to each other.

10. The set according to claim 9, wherein two different configurations of edge stones (42, 43) are arranged in alternation along the limitation of the ground covering, with a first edge stone (42) having, in a region of the lower stone part (16), a part-projection (44) which corresponds to the central projection (18) of an adjacent paving stone (10), and with a second edge stone (43) having, in a region of the lower stone part (16), a corner projection (45) which corresponds to the depression (19) of an adjacent paving stone (10).

11. A set of paving stones made of concrete for producing paved surfaces, with a curved set (47) of curved stones (46) of a wedge-shaped form, wherein:

the curved stones (46) comprise an upper stone part (15) and a lower stone part (16) having a first projection (18), a depression (19) and two comer projections (25);

the lower stone part (16) projects at a longitudinal side (11) to form the first projection (18) whose horizontal projection extends partially beyond an outer contour of the upper stone part (15);

at a longitudinal side (12) opposite the first projection (18), the lower stone part (16) partially projects to form two comer projections (25) in its horizontal projection with respect to the outer contour of the upper stone part (15);

between the comer projections (25), the lower stone part (16) is partially recessed to form a depression (19) in its horizontal projection with respect to the outer contour of the upper stone part (15);

the first projection (18) and the depression (19) have a trapezoid-shaped horizontal projection and are formed with corresponding dimensions;

the two corner projections (25) are formed in their common horizontal projection to correspond to the depression (19);

two upright transverse sides (13, 14) of the curved stone (46) run essentially continuously over the lower stone part (15) and the upper stone part (16);

opposite longitudinal sides (11, 12) of the curved stone (46) converge toward each other; and a plurality of curved sets (47), laid next to one another, form a paved surface with a curved layout, wherein the first projections (18) and the depressions (19) of adjacent curved stones (46) of the curved sets lying next to each other correspond to one another for being laid with a horizontal and vertical interlocking composition.

12. Device for producing paving stones from concrete, to be specific curved stones (46) with undercuts for vertically linking adjacent paving stones or curved stones (46), in a concrete mould which rests on an underlay which can be pulled away to the side in a horizontal plane, to be specific on a pulling plate (49), on the upper side of which ridges are arranged for limiting side surfaces of the paving stones, characterized in that the moulding ridges (51) are formed such that they diverge in the pulling direction of the pulling plate (49), with an increasing transverse dimension or width.

13. Device according to claim 12, characterized in that the paving stones or curved stones (46) are arranged within the concrete stone mould in rows in such a way that transverse rows (53) of the paving stones running in the pulling direction of the pulling plate (49) have a wedge-shaped cross section that decreases in the pulling direction.

* * * * *